US005186190A

United States Patent [19]

Hirzel

[11] Patent Number: 5,186,190

[45] Date of Patent: Feb. 16, 1993

[54] EYEBROW STENCIL KIT WITH ALIGNMENT MEMBERS

[76] Inventor: Suzy C. Hirzel, 933 Shellwood Way, Sacramento, Calif. 95831

[21] Appl. No.: 449,393

[22] Filed: Dec. 7, 1989

Related U.S. Application Data

[63] Continuation-in-part of Ser. No. 187,304, Apr. 28, 1988, abandoned.

[51] Int. Cl.[5] ..... A45D 40/30

[52] U.S. Cl. ..... 132/319; 132/216

[58] Field of Search ..... 132/216, 218, 319, 320

[56] References Cited

U.S. PATENT DOCUMENTS

| | | | |
|---|---|---|---|
| 1,812,425 | 6/1931 | Wasse | 132/216 |
| 2,394,799 | 2/1946 | Morley et al. | 2/445 |
| 2,435,516 | 2/1948 | Samson | 132/216 |
| 2,628,626 | 2/1953 | Teillaud | 132/216 |
| 2,917,058 | 12/1959 | Ferrar | 132/216 |
| 3,557,805 | 1/1971 | Hamade | 132/216 |
| 3,718,145 | 2/1973 | Chateau | 132/216 |

FOREIGN PATENT DOCUMENTS

| | | | |
|---|---|---|---|
| 717320 | 9/1968 | Canada | 132/319 |
| 789089 | 8/1935 | France | 132/319 |
| 1222311 | 6/1960 | France | 132/216 |
| 1328522 | 4/1963 | France | 132/319 |

*Primary Examiner*—Gene Mancene
*Assistant Examiner*—Frank A. LaViola

[57] ABSTRACT

For the purpose of mobility a pair of wing shape stencils is connected by a nut and screw passing through the elongated slots which allows the stencils to move horizontally and vertically. This procedure allows the adjustment of horizontal distance and an angle of the eyebrow cut-outs simultaneously. When the two stencils are connected the V- shapes formed thereby, provide centering guides. The stencil may have one or more eyebrow cut-outs generally in the middle area with a additional eyebrow line at the upper edge and an eyeline shadow guide at the lower edge. The stencils are supported by stretchable head bands and clips which are secured around the head during the application.

6 Claims, 2 Drawing Sheets

EYEBROW STENCIL KIT WITH ALIGNMENT MEMBERS

This application is a continuation-in-part of Ser. No. 07/187,304, filed Apr. 28, 1988, now abandoned.

BACKGROUND OF THE INVENTION

1. Field of Invention

The present invention relates to a make-up tool, more particularly intended for drawing eyebrows and eyelines with an alignment means.

2. Prior Art

It is easy to draw one eyebrow and/or eyeline at a time, but trying to match the shape of other eyebrow is not as easy, because eyebrows and eyelines have curvatures which make it difficult to draw them exactly the same every time. There are several previous inventions related to my present invention, and the I will point out the difference as following:

PREVIOUS INVENTION

U.S. Pat. No. 2,628,626

G.Q. TEILLAUD invented a pivot connection to make angular adjustments, however it is missing the element that can adjust eyebrow distance horizontally. Also TEILLAUD's invention is a molded thick plastic template which only allows for penciling against a single edge, and not a total shape of an eyebrow.

PREVIOUS INVENTION

U.S. Pat. No. 3,557,805

Hamada invented a apparatus for facilitating the delineation of desired patterns of eyebrows which has an elastic band. However, Hamada's invention does not include center guides, also there are no eyebrow shaped cut-outs to fill in to draw the perfect eyebrow. Hamada's device can be adjustable horizontally but not angular direction.

F.D. CHATEAU invented a method for custom fitting a person with an eyebrow stencil. Chateau's invention does not have any elements to adjust the angles or horizontal distances.

PREVIOUS INVENTION

U.S. Pat. No. 3,485,251

L. BRUNET Invented an eyeline guide, which is only for marking the eyelines. This long process involves cutting strips and gluing them and does not have any aligning means.

All the above inventions have some of the elements to draw eyebrows, however none above provide elements that adjust, align angles and horizontal distances of the eyebrow stencils all at the same time as the present invention.

G. Wosse invented eyebrow stencil, Jun. 30, 1931, U.S. Pat. No. 1,212,425, which has plurality eyebrow cut-outs in the stencil. However it does not have adjusting element for spacing nor angling for the stencils.

SUMMARY OF THE INVENTION

To summarize, the present invention provides a stencil to be used in the applying of make-up. The objective of the present invention is to provide a stencil which will define, stylish, eyebrow lines along with eyelines or shadow guide. The assembly is comprised of a pair of stencils, a nut and screw, clips and elastic bands. The generally octagon shape is made of flexible, thin and durable material, such as plastic, especially polyethylene. The upper edge of the stencil can be used as an additional eyebrow line while the lower edge can be used as an eyeline guide. Each stencil has several eyebrow shape cut-outs, generally in the middle area. At the corner of the inner stencil there is a horizontal elongated slot. The horizontal slot may have guiding element, such as demarcation, or patterns for faster, and accurate guiding. The pair of stencils are joined together by a securing element, such as screw and bolt, which can be easily manipulate the stencils. Said screw head is flat, so when assembly is on the face, screw head will not scratch or make marks. Also the screw is turnable by hand. The screw will go through the both stencil's elongated slot. This procedure allows the two stencils to move up and down or slide horizontally, which allows for changes in the degree of the angles and the horizontal distance between the eyebrow cut-outs. The joining of the two stencils creates a V-shape at the center of the stencil unit, which acts as a centering guide. The stencil is held onto the eye area of the face by adjustable, stretchable bands having clips, velcro or other securing element, which allow for easy connection and disconnection of the stencil unit. An additional clip is provided on one of the head bands for easy band length adjustment.

The complete eyebrow stencil kit can be snugly fastened around the head with the eyebrow shape cut-out positioned over the eyebrows, and the V-shape at the center above the nose. The kit will allow perfectly aligned drawings of the eyebrows. Eyebrow pencils can be used for the thin lines or sponge tip applicators for a softer look.

DETAILED DESCRIPTION

Figure 1:
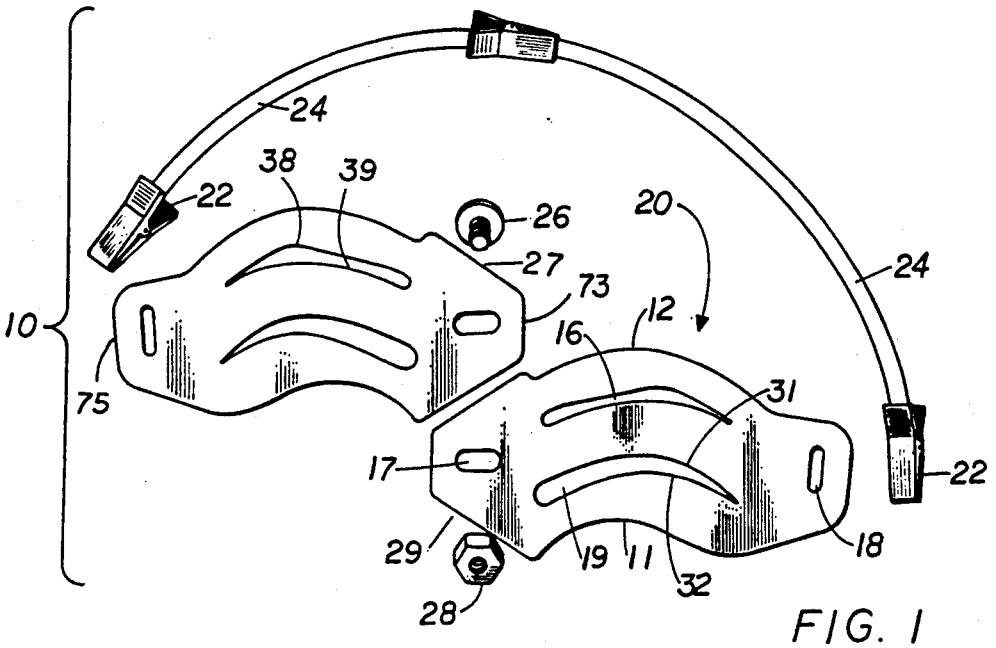
FIG. 1: is a schematic exploded front view of the first embodiment of the eyebrow stencil kit.
Figure 2:
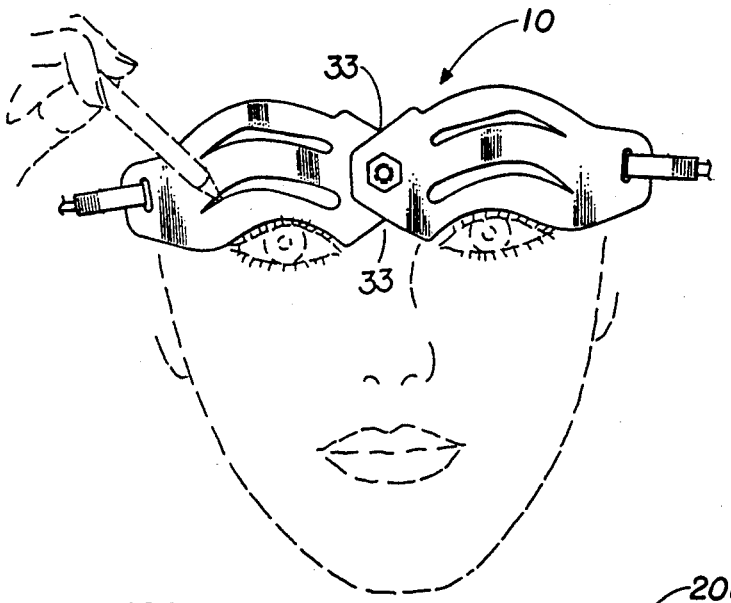
FIG. 2: is a schematic front view of the first embodiment of the stencil kit placed on the user's face and ready to draw the eyebrow.

Now referring more particularly to the accompanying drawings, a first preferred embodiment of the improved assembly of the present invention is schematically depicted in FIGS. 1 and 2. Thus, assembly 10 is shown, which comprises generally a pair of octagon or a wing shaped stencil 20 having a upper edge 12, lower edge 11, inner side 73, outer side 75, upper slant 27 and lower slant 29. Lower edge 11 is generally curved as upper eyeline or eye shadow shape, so it can be used as a eyeline, eye shadow guide.

Both stencils 20 having eyebrow shape cut-outs 16/19, said eyebrow cut-outs 19 having upper edge 31, and lower edge 32. Eyebrow shape cut-outs 16 having lower edge 39 and upper edge 38 which is located above cut-out 19.

Eyebrow cut-outs 16 and 19 can be filled in with eyebrow powders or pencils, lower edges 32 and 39, and upper edges 38 and 32 can be used as additional eyebrow line guides. Eyebrow cut-outs 16 and 19 can be any eyebrow shape or size.

Horizontal slot 17 is comprised of generally elongated opening with several notches or indentation marks 40 for adjusting space, and angles between the stencils. Slot 17 is located in between the slanted upper edge 27 and lower edge 29.

Both stencils 20 are connected by screw 26 and nut 28; said screw 26 goes through slots 17 and is tightened by nut 28. Horizontal slots 17 are horizontally elongated shapes, in order to enable the stencils to move horizontally and up and down. The degree of the angles of the stencils can also be adjusted. When the two stencils are connected, slanted edges 27 and 29 create the "V" shape, which is the centering guide 33 [FIG. 2]. Vertical slots 18 are located in the outer corner of the stencils for securing the connecting element 22, which are connected to the stretchable head bands 24. However, connecting element 22 can be VELCRO, sewn on, or bonded agent.

To use assembly, secure the clips 22 to the slots 18 and fasten the bands 24 on the head. Adjust the distance between the eyebrows and change the angles of the stencils by nut 26 and screw 28. Position eyebrow cut-out 19 on the eyebrow and draw with a pencil or fill in with a sponge tip applicator. To use eyebrow cut-out 16, simply move the assembly to a lower position, look through the cut-outs 19.

Figure 3:
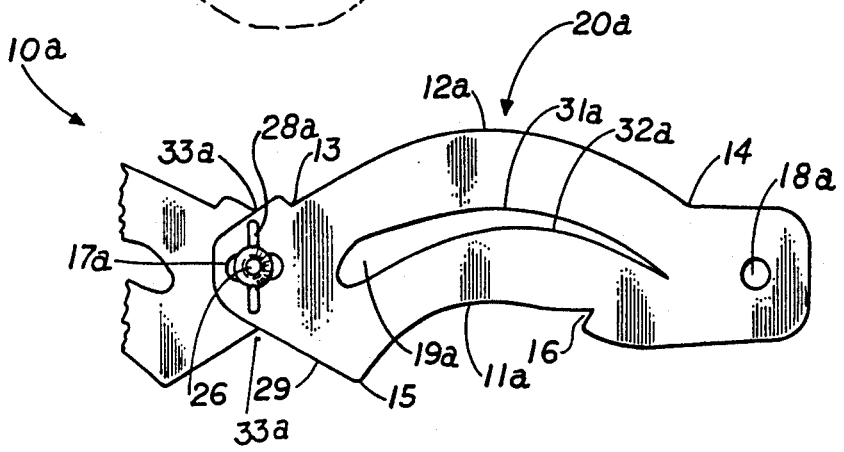
FIG. 3: is a schematic front view of the second embodiment of the part of the stencils.
Figure 4:
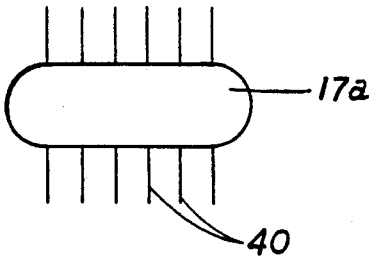
FIG. 4: is a schematic front view of the enlargement of the second embodiment of the connecting elongated slot with space mark indentations.

A second preferred embodiment of the improved assembly of the present invention is schematically depicted in FIGS. 3 and 4. Thus, assembly 10*a* is shown.

Components thereof similar to those of assembly 10 bear the same numerals, but are succeeded by the letter "a", except new numerals. Assembly 10*a* is a simplified version of the present invention and substantially identical to assembly 10, except in the following respects:

a) stencils 20*a* having a single eyebrow shape cut out 19*a;*
b) securing member 28*a* is a wing nut, for easier handling.
c) eyeline guide 11*a* having the starting point 15 and end point 16;
d) slot 17*a* having space adjusting mark 40 for accurate horizontal distance adjustment.

Figure 5:
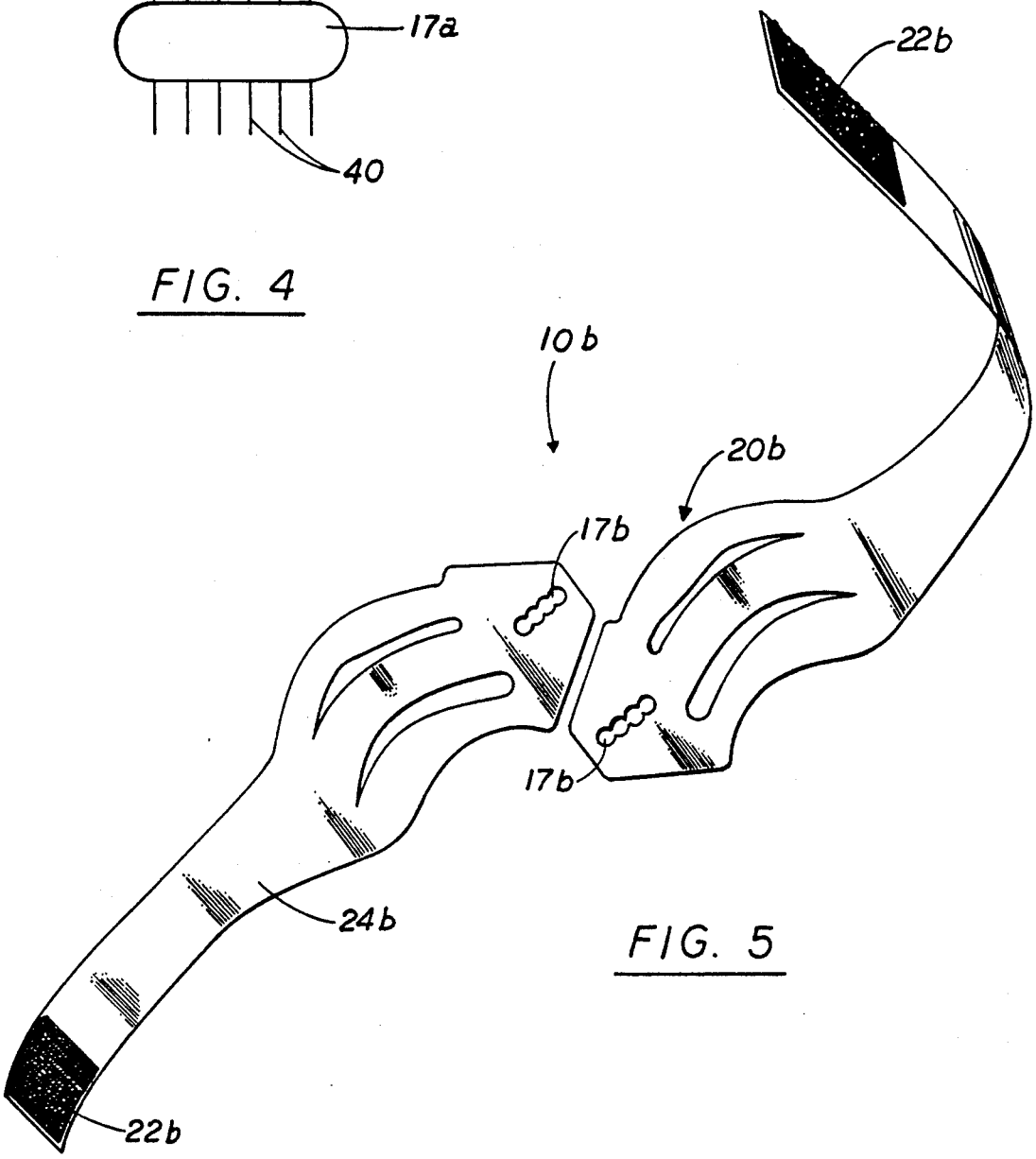
FIG. 5: is a schematic front view of the third preferred embodiment of the present invention, before assembled.
Figure 6:
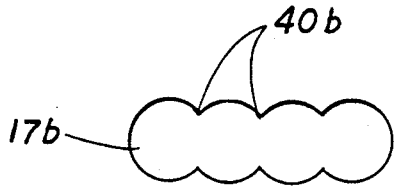
FIG. 6: is a schematic front view of the enlarged elongated scalloped pattern slot, part of the third embodiment.

A Third preferred embodiment of the improved assembly of the present invention is schematically depicted in FIGS. 5 and 6. Thus, assembly 10*b* is shown.

Components thereof similar to those assembly 10 and bear the same numerals, but are succeeded by the letter "b".

Assembly 10*b* is substantially identical to assembly 10 and 10*a*, except in the following respect:

a) stencil 20*b* and band 24*b* is made of one piece.
b) 24*b* having velcro closure 22*b* or other existing closing means.
c) elongated opening 17*b* has scallop shaped edge 40*b* for easier adjustment for individuals.

Stencil 20, 20*a* and 20*b* can be made from paper, plastic, metal rubber or fabric, but in this case applicant prefer to use polyethylene material, which is durable, washable and flexible.

The stencils are thinner than 2 mm.

Various modifications, changes, alterations and additions can be made in the present invention, its components and their parameters. All such modifications, changes, alterations and additions as are within the scope of the appended claims form part of the present invention.

OBJECTS AND ADVANTAGES

Accordingly, the applicant claims the following as her objects and advantages of the invention: to provide a kit that will easily, accurately, reliably and neatly align and draw the eyebrows and eyelines, regardless of the shape of the eyebrows, or location of the eyebrows.

In addition the applicant claims, the kit is helpful in choosing the best style of the eyebrow for their face structure, personality, mood and wardrobe. A further advantage claimed by the applicant is that the kit is helpful to those who wear glasses; because the kit can be worn on the face simultaneously with the glasses during make-up application. In this case a flat sponge applicator with cream and eyebrow powder should be used.

The stencil has three or six eyebrow curves: to edge, lower edge and eyebrows shape cut-outs, and with a maneuverable function, which can create many different angles and adjustment of the stencils. The applicant intends to produce various eyebrow and eyeline stencil units, so users can interchange various stencils with the easily attachable supporting band.

Because stencil unit is made with thin, flexible, durable material like polyethylene, it can be easily cleaned and stored. This kit can be made very inexpensively.

What is claimed is:

1. An improved eyebrow and eyeline stencil device comprising a pair of stencils, each adapted to lie above an eye, each stencil comprising, in combination, an upper edge, a lower edge, and inner and outer ends, a stencil slot having an inner end and an outer end with the inner end of said stencil slot enlarged and tapering outwardly in a curved direction to correspond with the shape of a person's eyebrows, said lower edge curved to follow the contour of the person's upper eyeline and forming an eyeline guide for the application of eyeliner, said inner end of said stencil having a horizontally elongated slot, connecting means pivotally connecting said horizontally elongated slots allowing both the horizontal distance and the angular direction with respect to the horizontal to be adjusted, said connecting means further comprising means to fixedly maintain said pair of stencils in a desired position, said upper edge of said stencil having a first slanted outer surface located above said horizontally elongated slot such that when said pair of stencils are pivotally connected by said connecting means, each said first slanted outer surfaces together create a first V-shape at the center of said stencil device allowing easy centering of said device above the person's nose, said lower edge of said stencil having a second slanted outer surface located below said horizontally elongated slot such that when said pair of stencils are pivotally connected by said connecting means, each said second slanted outer surfaces together create a second V-shape at the center of said stencil device allowing easy centering of said device above the person's nose, said stencil device further comprising a securing means to secure said stencil device to the person's head, whereby said stencil device may be secured to the person's head, centered above the person's nose and adjusted and fixedly maintained in said desired position such that makeup may be applied accurately to both the eyebrows and upper eyelines.

2. The improved eyebrow and eyeline stencil device of claim 1, wherein said connecting means comprise a nut and a screw.

3. The improved eyebrow and eyeline stencil device of claim 2, wherein said nut and said screw are composed of nylon.

4. The improved eyebrow and eyeline stencil device of claim 1, wherein said securing means comprises a stretchable band secured to the person's head by means of clips.

5. The improved eyebrow and eyeline stencil device of claim 1, wherein said securing means comprises a band with hook and loop fasteners.

6. The improved eyebrow and eyeline stencil device of claim 1, wherein said horizontally elongated slot has marks for accurate adjusting for horizontal distance and angular degree.

* * * * *